US010799748B2

(12) United States Patent
Chang

(10) Patent No.: US 10,799,748 B2
(45) Date of Patent: Oct. 13, 2020

(54) INTERACTING EXERCISE DEVICE

(71) Applicant: Chung-Fu Chang, Changhua County (TW)

(72) Inventor: Chung-Fu Chang, Changhua County (TW)

( * ) Notice: Subject to any disclaimer, the term of this patent is extended or adjusted under 35 U.S.C. 154(b) by 32 days.

(21) Appl. No.: 16/192,710

(22) Filed: Nov. 15, 2018

(65) Prior Publication Data

US 2019/0151701 A1 May 23, 2019

(30) Foreign Application Priority Data

Nov. 17, 2017 (TW) ..... 11147192 A

(51) Int. Cl.

| | |
|---|---|
| ***A63B 21/06*** | (2006.01) |
| ***A63B 22/06*** | (2006.01) |
| ***A63B 21/00*** | (2006.01) |
| ***A61H 1/00*** | (2006.01) |
| ***A63B 21/22*** | (2006.01) |

(52) U.S. Cl.

CPC ..... *A63B 21/0608* (2013.01); *A61H 1/005* (2013.01); *A63B 21/00196* (2013.01); *A63B 21/22* (2013.01); *A63B 22/0605* (2013.01); *A63B 21/4035* (2015.10); *A63B 21/4049* (2015.10)

(58) Field of Classification Search

CPC .. A61H 1/00; A61H 1/005; A61H 2201/0153; A61H 2201/0157; A61H 2201/12; A61H 2201/1215; A61H 2201/1253; A61H 2201/14; A61H 2201/1418; A61H 2201/1436; A61H 2201/1463; A61H 2201/1472; A61H 2201/1481; A61H 2201/149; A63B 21/00; A63B 21/00196; A63B 21/06; A63B 21/0601; A63B 21/0607; A63B 21/0608; A63B 21/22; A63B 21/222; A63B 21/40; A63B 21/4027; A63B 21/4033; A63B 21/4035; A63B 21/40405; A63B 21/4049; A63B 22/00; A63B 22/06; A63B 22/0605; A63B 22/0611; A63B 22/0617

See application file for complete search history.

(56) References Cited

U.S. PATENT DOCUMENTS

| | | | | |
|---|---|---|---|---|
| 3,062,543 A * | 11/1962 | Shaboo | ..... | A63B 21/0004 482/110 |
| 3,845,758 A * | 11/1974 | Anderson | ..... | A61H 15/0085 601/114 |
| 8,118,717 B1 * | 2/2012 | Lai | ..... | A63B 21/0726 482/108 |
| 2012/0129653 A1 * | 5/2012 | Shalev | ..... | A61H 7/001 482/1 |

* cited by examiner

*Primary Examiner* — Jennifer Robertson
(74) *Attorney, Agent, or Firm* — Raymond Y. Chan; David and Raymond Patent Firm

(57) ABSTRACT

An interacting exercise device is revealed. The interacting exercise device includes a driving device and a non-concentric actuator driven by the driving device. While the driving device is operated to rotate, the non-concentric actuator vibrates and the vibration generated is delivered to the interacting exercise device for interacting shaking fitness.

9 Claims, 8 Drawing Sheets

INTERACTING EXERCISE DEVICE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an exercise and rehabilitation device, especially to an interacting exercise device.

Description of Related Arts

One of the rehabilitation and exercise devices available now is an electric passive motion training device. For example, refer to Taiwanese Pat. No. M324518, a vibration fitness platform is revealed. The platform includes an electric vibration component by which the platform exerts vibrations on users' bodies to simulate nerves at different positions of the body. The users' limbs are passively stimulated and moved by the vibration for preventing muscular from reduced tension, atrophy, and degeneration. The platform can also help users to move their bones and joints for relieving stiffness and tensions.

However, the fitness platform provides only passive motions and users don't move their bodies at all. Thus the fitness platform only provides superficial and limited effects on the personal fitness. There is room for improvement and there is a need to provide an interacting exercise device that not only provides passive and active motions but also overcomes the above shortcomings.

SUMMARY OF THE PRESENT INVENTION

Therefore it is a primary object of the present invention to provide an interacting exercise device that includes a plurality of wheel sets used to drive a non-concentric actuator. Owing to unbalanced centrifugal force resulted from a counter weight arranged at the non-concentric actuator, the non-concentric actuator has a run-out that causes vibration. The vibration is then delivered to the exercise device so that users' bodies are shaken passively while they are moving their bodies actively. Thereby the exercise device provides the effects of exercise and stimulus physical therapy.

In order to achieve the above object, an interacting exercise device according to the present invention is composed of a driving device, at least two shafts and a non-concentric actuator. The driving device consists of a driving wheel and a driven wheel set. The shaft is inserted into the exercise device. One end of the respective shaft is protruding from the exercise device to be connected to an operation portion while the other end of one of the shaft is passed through the driving wheel. The other end of the other shaft is passed through the driven wheel set. The driving wheel is corresponding to the driven wheel set while the driven wheel set is corresponding to the non-concentric actuator. The driven wheel set is composed of a large wheel and a small wheel coaxially disposed on one side of the large wheel. The non-concentric actuator includes a disc and a tiny wheel arranged at one side of the disc. A counter weight is mounted on one end of the disc or each of two ends of the disc. A diameter of the driving wheel is larger than that of the small wheel of the driven wheel set. The driving wheel drives the small wheel of the corresponding driven wheel set while the large wheel of the driven wheel set drives the tiny wheel of the corresponding non-concentric actuator.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
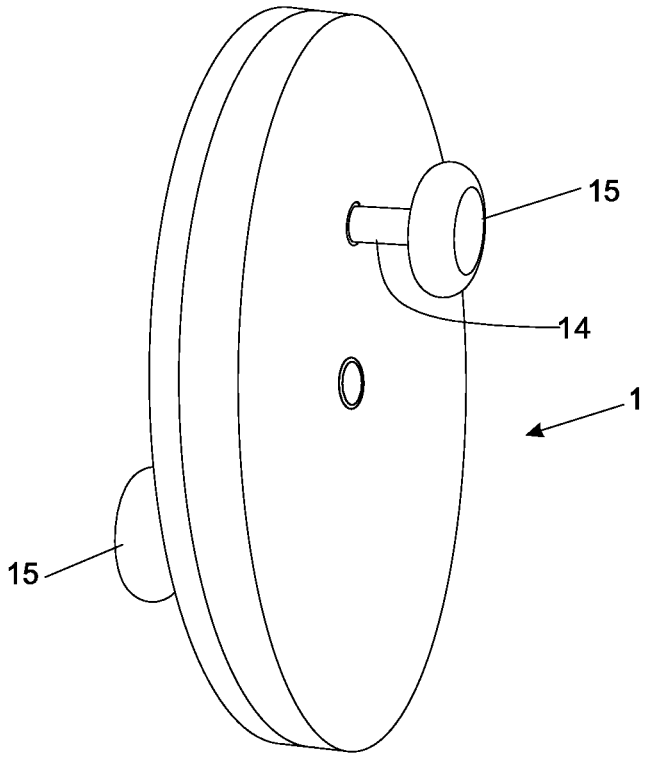
FIG. 1 is a perspective view of an embodiment according to the present invention.
Figure 2:
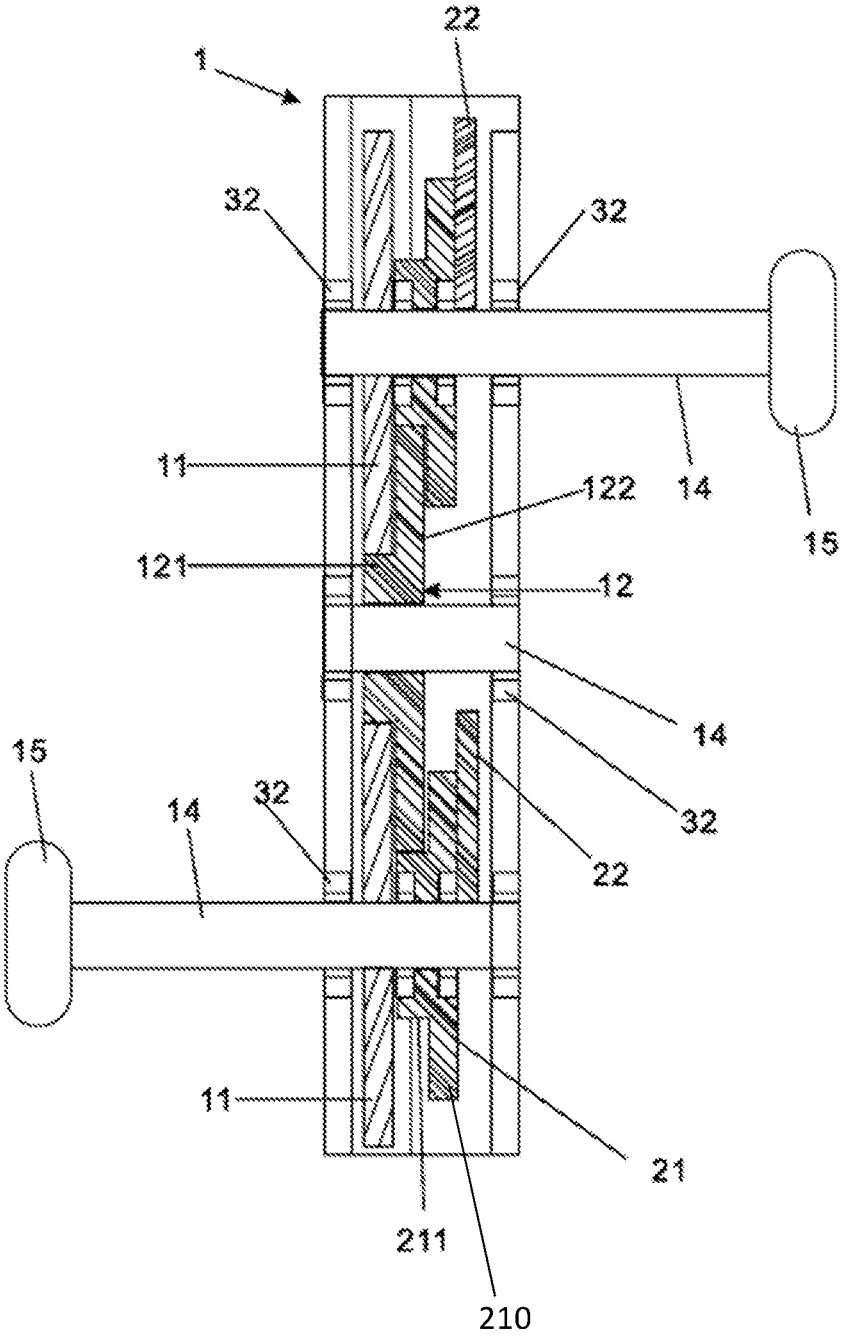
FIG. 2 is a schematic drawing showing structure of an embodiment according to the present invention.
Figure 3:
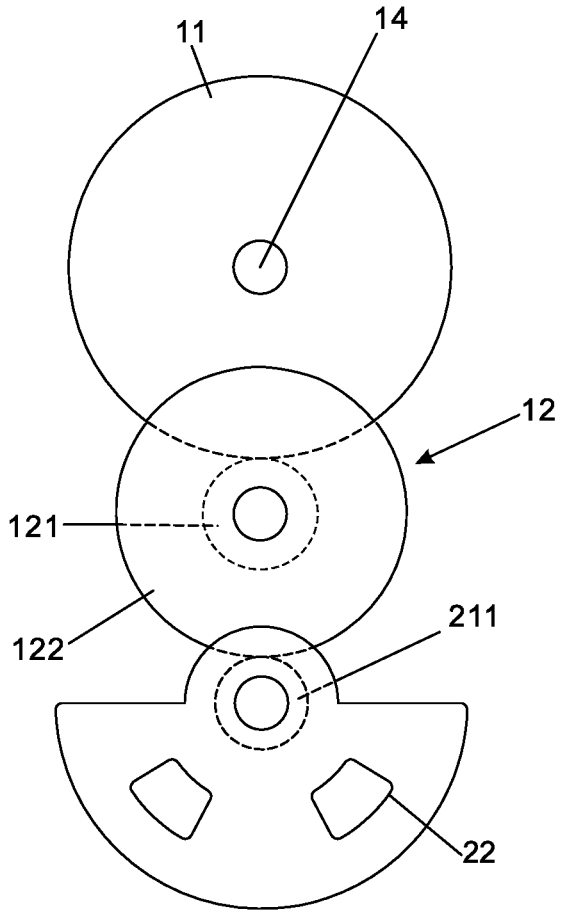
FIG. 3 is a schematic drawing showing a driving wheel driving a driven wheel set and the driven wheel set driving a non-concentric actuator of an embodiment according to the present invention.

Refer to FIG. 1-3, an interacting exercise device 1 includes a driving device, at least two shafts 14, at least two operation portions 15 and a non-concentric actuator 21 mounted in a mounting space of the device 1. The driving device comprises at least one driving wheel 11 and at least one driven wheel set 12. As shown in FIG. 2, according to the preferred embodiment, a pair of driving wheels 11 is provided, the at least two shafts 14 are inserted into the device 1 and at least two bearings 32 are respectively arranged at positions where the at least two shafts 14 are connected to the device 1. One end of each of the shafts 14 is protruding from the device 1 and connected to one of the operation portions 15 while the other end of one of the shafts 14 is passed through the driving wheel 11 and the non-concentric actuator 21. The other end of the other shaft 14 is passed through the driven wheel set 12 whose axial center is fixed on the shaft 14. The driving wheel 11 is fixed on the shaft 14. As to the non-concentric actuator 21, another bearing 32 is arranged at an axial center of the non-concentric actuator 21 so that the non-concentric actuator 21 is not affixed on the shaft 14. Instead of being affixed on the shaft 14, the non-concentric actuator 21 is limited by the shaft 14. Thereby the non-concentric actuator 21 and the driving wheel 11 are rotated independently. The driving wheel 11 is corresponding to the driven wheel set 12 while the driven wheel set 12 is corresponding to the non-concentric actuator 21. The driven wheel set 12 consists of a large wheel 122 and a small wheel 121 coaxially disposed on one side of the large wheel 122. The non-concentric actuator 21 includes a disc 210 and a tiny wheel 211 extended from one side of the disc. A counter weight 22 is arranged at one end of the disc or each of two ends of the disc. The counter weight 22 and the disc are arranged non-concentrically. The weight of the disc is distributed only on one end or on both ends of the disc. The counter weight 22 can be affixed on the disc or moveably connected to the disc. The diameter of the driving wheel 11 is larger than that of the small wheel 121 of the driven wheel set 12 while the diameter of the large wheel 122 of the driven wheel set 12 is larger than that of the tiny wheel 211 of the non-concentric actuator 21. As shown in FIG. 3, the driving wheel 11 drives the small wheel 121 of the corresponding driven wheel set 12 while the large wheel 122 of the driven wheel set 12 drives the tiny wheel 211 of the corresponding non-concentric actuator 21.

As shown in FIG. 2, the device 1 is rotated and the driving wheel 11 is rotated simultaneously when the operation portion 15 is driven by the movement of user's body. The driving wheel 11 drives the small wheel 121 of the driven wheel set 12. Owing to the gear ratio, the large wheel 122 drives the small wheel 121 so that the rotational speed of the driven wheel set 12 is increased. The optimal gear ratio of the wheels is ranging from 1:15 to 1:60. The large wheel 122 of the driven wheel set 12 further drives the tiny wheel 211 of the non-concentric actuator 21. Thereby the non-concentric actuator 21 is rotated quickly. The driven wheel set 12 is rotated fast simultaneously and the non-concentric actuator 21 is also driven to rotate quickly once the driving wheel 11 is driven to rotate by the movement of the user's body. Owing to unbalanced centrifugal force thereof, the non-concentric actuator 21 has a run-out that causes vibration and the vibration is transmitted to the main body of the device 1 first and then the vibration is further transmitted from the device 1 to the user's body. Therefore the present device 1 provides both passive motion and active motion.

Figure 4:
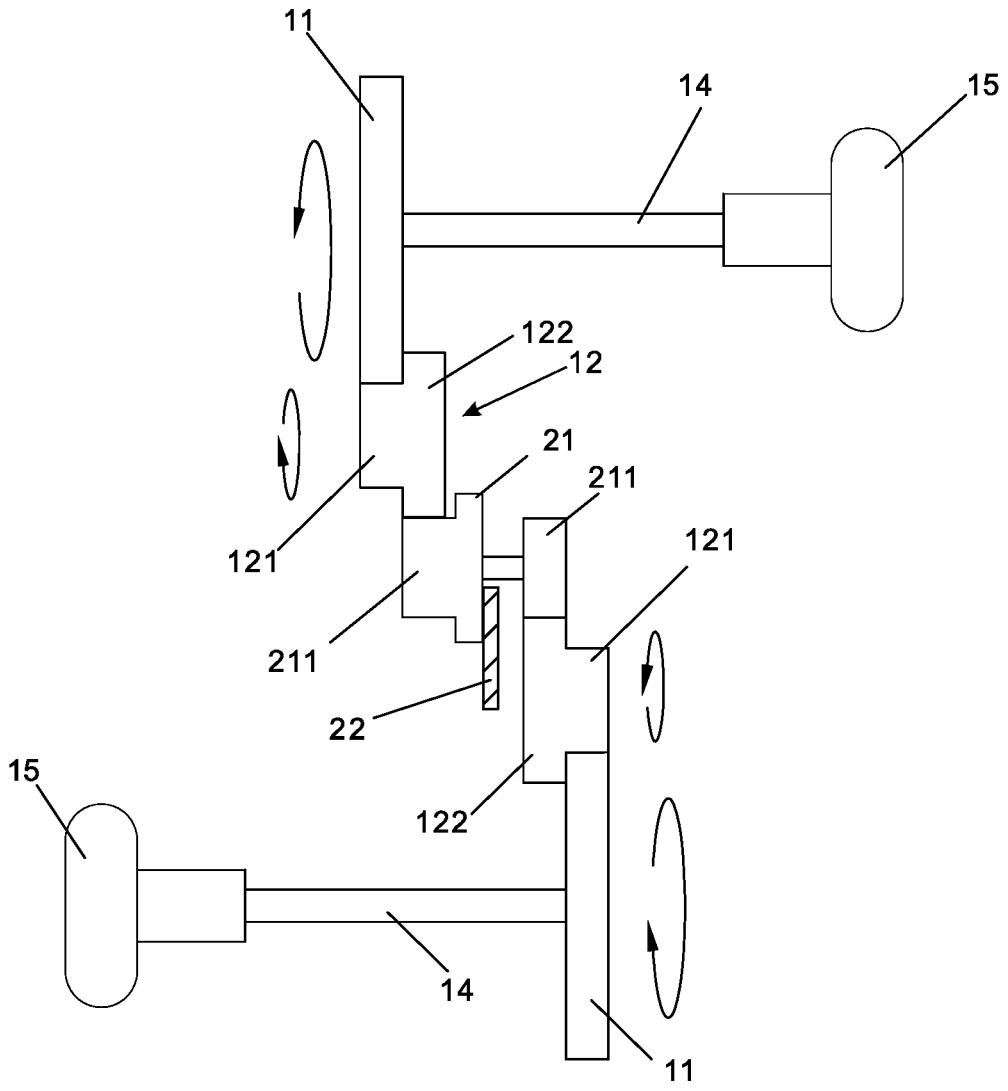
FIG. 4 is a schematic drawing showing another embodiment according to the present invention.

In other embodiments, the present invention can be various combinations of different components, not limited to the above combination. Refer to FIG. 4, the embodiment includes a pair of driving wheels 11 arranged at the left side and the right side of the device 1 respectively and a pair of driven wheel sets 12 also disposed on the left side and the right side of the device 1 correspondingly. Each of the driving wheels 11 drives one of the driven wheel sets 12 correspondingly and each of the driven wheel sets 12 is corresponding to a non-concentric actuator 21.

Figure 5:
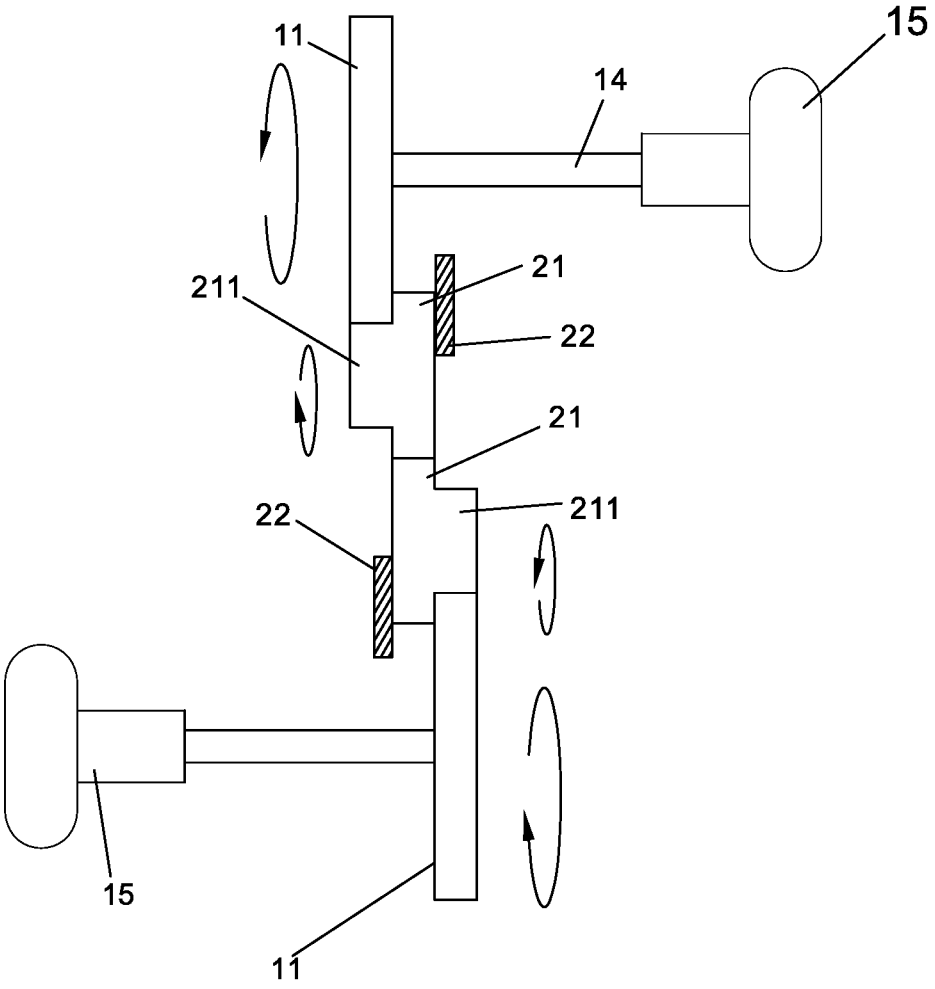
FIG. 5 is a schematic drawing showing a further embodiment according to the present invention.

As shown in FIG. 5, according to another preferred embodiment, a pair of driving wheels 11 is set on the left side and the right side of the device 1 respectively and a pair of non-concentric actuators 21 and a pair of counter weights are provided and arranged at the left side and the right side of the device 1 respectively while each driving wheel 11 drives the corresponding non-concentric actuator 21.

Figure 6:
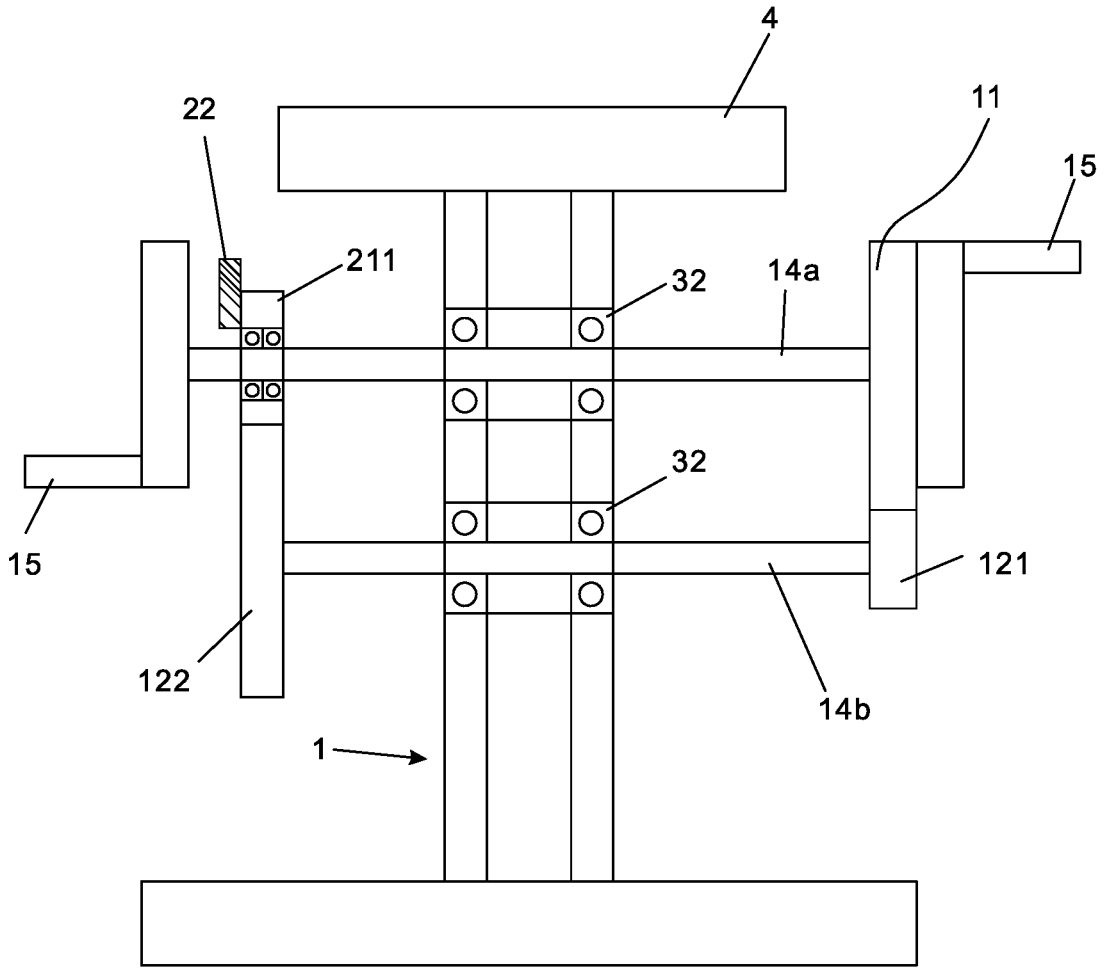
FIG. 6 is a schematic drawing showing a further embodiment according to the present invention.

Refer to FIG. 6, according to another preferred embodiment, the device 1 comprises a first shaft 14*a* and a second shaft 14*b* parallel to each other. One end of the first shaft 14*a* is axially provided with a driving wheel 11 and an operation portion 15 in turn while the non-concentric actuator 21 (with a tiny wheel 211) and an operation portion 15 are axially disposed on the other end thereof in turn. The non-concentric actuator 21 includes the tiny wheel 211 and a counter weight 22 set around the tiny wheel 22. A driven wheel set 12 having a large wheel 122 and a small wheel 121 is axially set on the second shaft 14*b* while the large wheel 122 and the small wheel 121 are axially arranged at two ends of the second shaft 14*b* respectively. A pair of bearings 32 is disposed on the positions where the first shaft 14*a* and the second shaft 14*b* are connected to the device 1 respectively. The driving wheel 11 is corresponding to the small wheel 121 while the large wheel 122 is corresponding to the tiny wheel 211 of the non-concentric actuator 21. When the user drives the two operation portions 15 to rotate, the driving wheel 11 is synchronously driven to rotate and further driving the small wheel 121 to rotate. Then the large wheel 122 axially disposed on the end opposite to the small wheel 121 drives the tiny wheel 211 of the non-concentric actuator to rotate.

Figure 7:
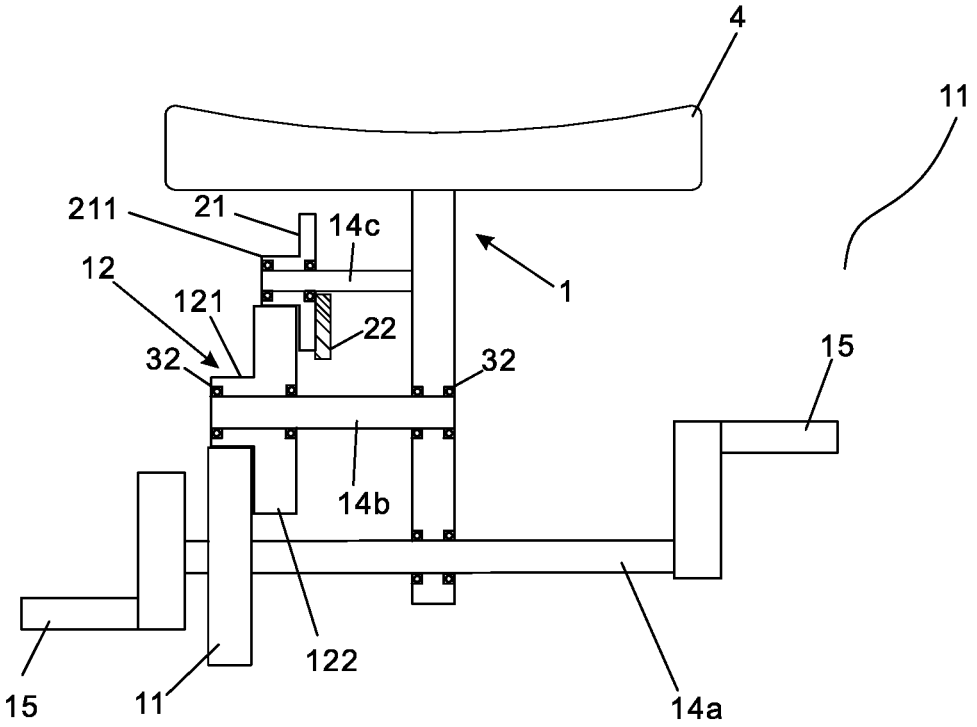
FIG. 7 is a schematic drawing showing a further embodiment according to the present invention.

Refer to FIG. 7, a further embodiment is disclosed. The present invention is applied to abdominal exercise devices. One end of the device 1 is provided with a contact part 4 which a part of user's body such as belly thighs, etc. is leaning against. A first shaft 14*a*, a second shaft 14*b* and a third shaft 14*c* are axially disposed on the device 1 and located parallel to each other. A driving wheel 11 and an operation portion 15 are axially arranged at one end of the first shaft 14*a* while the other end thereof is axially provided with an operation portion 15. A driven wheel set 12 having a large wheel 122 and a small wheel 121 extended from one side thereof is axially set on the second shaft 14*b*.

A non-concentric actuator 21 composed of a tiny wheel 211 and a counter weight 22 set therearound is axially disposed on the third shaft 14*c*. The positions where the first shaft 14*a* and the second shaft 14*b* are connected to the device 1 are provided with a bearing 32 respectively. Similarly, bearings 32 are also disposed on the positions where the driven wheel set 12 is connected to the second shaft 14*b* and where the non-concentric actuator 21 is connected to the third shaft 14*c* respectively. The driving wheel 11 is corresponding to the small wheel 121 while the large wheel 122 is corresponding to the tiny wheel 211 of the non-concentric actuator 21. When the user drives the two operation portions 15 to rotate, the driving wheel 11 is also driven to rotate at the same time and further driving the small wheel 121 to rotate. Then the large wheel 122 axially disposed on the end opposite to the small wheel 121 drives the tiny wheel 211 of the non-concentric actuator 21 to rotate.

Figure 8:
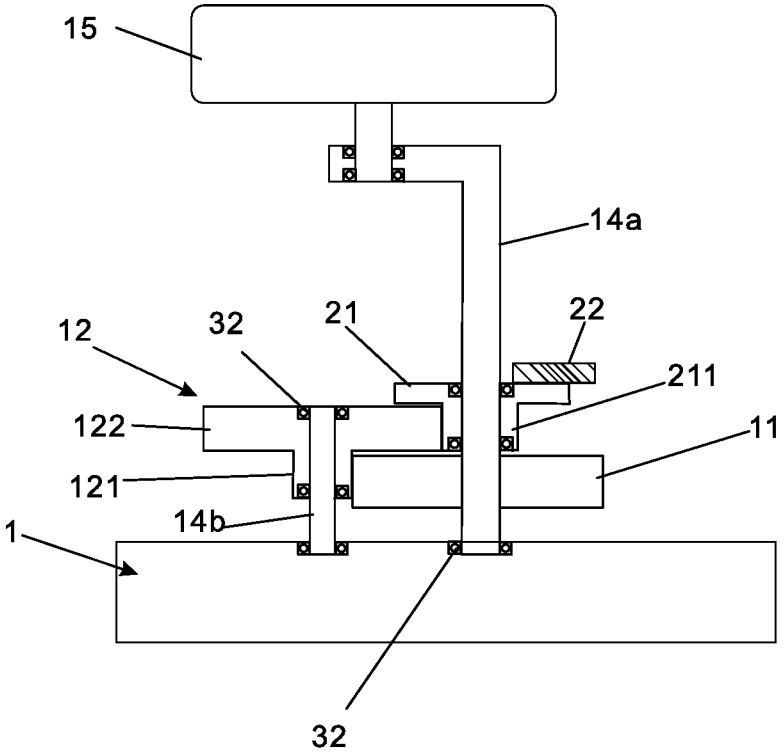
FIG. 8 is a schematic drawing showing a further embodiment according to the present invention.

Refer to FIG. 8, a further embodiment is revealed. The present invention is applied to an exerciser with a swivel seat. An operation portion 15 used as a seat for users is disposed on one end of the device 1. A first shaft 14*a* and a second shaft 14*b* are axially disposed on the device 1 and are parallel to each other. The first shaft 14*a* is a vertical rod with one end extended to form a bent rod while the other end thereof is axially provided with a driving wheel 11 and a non-concentric actuator 21. The non-concentric actuator 21 includes a tiny wheel 211 and a counter weight 22 arranged therearound. The operation portion 15 is axially arranged at the bent rod extended from the first shaft 14*a*. A driven wheel set 12 is axially disposed on the second shaft 14*b* and is composed of a large wheel 122 and a small wheel 121 extended from one side thereof. The positions where the first shaft 14*a* and the second shaft 14*b* are connected to the device 1 are provided with a bearing 32 respectively. Bearings 32 are also arranged at the positions where non-concentric actuator 21 is connected to the first shaft 14*a* and where the driven wheel set 12 is connected to the second shaft 14*b* respectively. The driving wheel 11 is corresponding to the small wheel 121 while the large wheel 122 is corresponding to the tiny wheel 211 of the non-concentric actuator 21. When the user sits on the operation portion 15 and drives the operation portion 15 to rotate, the driving wheel 11 is also driven to rotate at the same time and further driving the small wheel 121 to rotate. Then the large wheel

122 axially disposed on the end opposite to the small wheel 121 drives the tiny wheel 211 of the non-concentric actuator 21 to rotate.

The driving wheel 11 and the driven wheel set 12 can be gears or friction wheels that are transmitted by engagement of gears or a combination of chains and belts.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An interacting exercise device comprising:

at least a non-concentric actuator;

at least a driving device;

at least an operation portion;

at least two bearings; and at least two shafts, inserted into said interacting exercise device, wherein said driving device comprises at least one driving wheel and at least one driven wheel set, wherein said shafts are connected with said interacting exercise device through said bearings respectively, wherein an end of one of said shafts protrudes from said interacting exercise device and connected to said operation portion and the other end of said one of said shafts is passed through said driving wheel, wherein the other of said shafts is passed through said driven wheel set, wherein said driving wheel meshes with said driven wheel set, while said driven wheel set meshes with said non-concentric actuator, wherein said driven wheel set comprises a large wheel and a small wheel coaxially disposed on said large wheel, wherein said non-concentric actuator is passed through by one of said shafts, wherein said non-concentric actuator comprises a disc, a tiny wheel coaxially arranged on said disc, and a counter weight mounted on at least an end of said disc in an unbalanced manner, wherein a diameter of said driving wheel is larger than a diameter of said small wheel of said driven wheel set, while a diameter of said large wheel of said driven wheel is larger than a diameter of said tiny wheel of said non-concentric actuator, wherein when said operation portion is operated to drive said driving wheel to rotate, said driven wheel set is rotated faster than said driving wheel at the same time and said non-concentric actuator is further driven to rotate faster than said driving wheel by said driven wheel set, such that said non-concentric actuator shakes and vibrates owing to unbalanced centrifugal force, which renders shaking of said interacting exercise device.

2. The interacting exercise device, as claimed in claim 1, wherein one of said at least two bearings is disposed between one of said at least two shafts and said non-concentric actuator in the manner that said non-concentric actuator is limited by said shaft rather than affixed thereby.

3. The interacting exercise device, as claimed in claim 1, wherein one of said at least two bearings is arranged at an axial center of said driven wheel set.

4. The interacting exercise device, as claimed in claim 1, wherein said driving wheel is selected from the group consisting of a gear and a friction wheel transmitted through gear engagement.

5. The interacting exercise device, as claimed in claim 1, wherein said driven wheel set is selected from the group consisting of a gear and a friction wheel transmitted through gear engagement.

6. The interacting exercise device, as claimed in claim 1, wherein said tiny wheel of said non-concentric actuator is selected from the group consisting of a gear and a friction wheel transmitted through gear engagement.

7. The interacting exercise device, as claimed in claim 1, comprising a pair of said driving wheels, a pair of said driven wheel sets meshed with said pair of driving wheels respectively, and a pair of said non-concentric actuators meshed with said pair of driven wheel sets respectively, wherein said driving wheels are arranged respectively at a left side and a right side of said interacting exercise device, wherein said driven wheel sets are disposed on the left side and the right side of said interacting exercise device respectively, wherein said non-concentric actuators are arranged on the left side and the right side of said interacting exercise device respectively.

8. The interacting exercise device, as claimed in claim 1, wherein said counter weight is affixed on said disc.

9. The interacting exercise device, as claimed in claim 1, wherein said counter weight is moveably connected to said disc.

* * * * *